United States Patent [19]

Martin

[11] 4,391,118

[45] Jul. 5, 1983

[54] MECHANISM FOR FORMING A HOLE THROUGH A FORGED WORKPIECE

[75] Inventor: Wayne A. Martin, Pittsburgh, Pa.

[73] Assignee: United States Steel Corporation, Pittsburgh, Pa.

[21] Appl. No.: 261,071

[22] Filed: May 6, 1981

Related U.S. Application Data

[60] Division of Ser. No. 45,529, Jun. 4, 1979, Pat. No. 4,299,110, which is a continuation-in-part of Ser. No. 892,715, Apr. 3, 1978, abandoned.

[51] Int. Cl.[3] ..... B21D 28/00

[52] U.S. Cl. ..... 72/356; 72/324; 72/329; 72/338

[58] Field of Search ..... 83/652, 653, 654, 655, 83/656, 657, 681, 682, 684; 72/324, 325, 338, 353, 327, 329, 356, 464

[56] References Cited

U.S. PATENT DOCUMENTS 503,354 8/1893 Pearson ..... 72/356
1,630,988 5/1927 Tyler ..... 83/654
3,411,208 11/1968 Malm ..... 83/652
3,638,477 2/1972 Martin ..... 72/377

*Primary Examiner*—Lowell A. Larson
*Assistant Examiner*—David B. Jones
*Attorney, Agent, or Firm*—William F. Riesmeyer, III

[57] ABSTRACT

A method and mechanism for forming a hole through a forged workpiece. During the forging operation an indentation is formed in the upper surface of the workpiece. While the workpiece remains in the forging press, a trepanning tool is placed in the indentation and the top die of the press is used to force the tool almost through the workpiece leaving a thin wall at the bottom of the hole. The workpiece either may be removed from the press while the wall is knocked out to complete the hole, or preferably the workpiece remains in the press and the top die is used to knock out the wall. If the workpiece remains in the press, preferably it is supported on a locating ring which aligns the workpiece and trepanning tool with the top die. Also disclosed is an improved trepanning tool which has external and internal sloping faces extending around its circumference at its lower end.

4 Claims, 8 Drawing Figures

MECHANISM FOR FORMING A HOLE THROUGH A FORGED WORKPIECE

This is a division of application Ser. No. 045,529, filed June 4, 1979, now U.S. Pat. No. 4,299,110 which is a continuation-in-part of my co-pending application, Ser. No. 892,715 filed Apr. 3, 1978 now abandoned.

This invention relates to an improved method and mechanism for forming a hole through a forged workpiece.

The invention is intended mainly as an improvement over the forging press and method disclosed and claimed in my earlier U.S. Pat. No. 3,638,471 of common ownership, the disclosure of which is incorporated herein by reference. The press disclosed in my earlier patent includes a top die holder which is circular in plan. The top die holder is relatively narrow in width and its longitudinal center line lies directly over the diameter of the bottom die holder when the parts are positioned for forging a workpiece. The bottom die holder is mounted on an indexing table which enables it to be rotated about a vertical axis. The two die holders carry appropriate sets of dies for shaping a workpiece to the desired contours. In operation, a previously heated workpiece is supported on the bottom dies while the top dies are brought down repeatedly against it. The indexing table rotates the bottom die holder, dies and workpiece through a pattern of arcs between operations of the top dies. With repeated indexing, the workpiece is shaped throughout its area. Nevertheless the method and mechanism of the present invention can be applied to other forging presses, and the invention is not limited to use with the method and press shown in my earlier patent.

In many instances the forged workpiece is required to have a hole through its center, for example a forging for a turbine bucketwheel. My earlier patent shows dies which form relatively large indentations at the central portion of the workpiece in both the upper and lower surfaces. The practice prior to the present invention was to remove the workpiece from the press, cool it to about 320 C., normalize and temper it, descale it, measure the diameter, mark lines on it for flame-cutting, heat it to about 350 to 400 C., and flame-cut the hole as well as the outer circumference. Thereafter the workpiece was stress-relief annealed, which requires about six hours in a furnace. The indentations provide a relatively thin web at the central portion and thus facilitate the flame-cutting operation.

The prior practice has several disadvantages. It is difficult to produce a good flame-cut surface at the hole, and sufficient stock must be left to allow for the possibility of blow holes, A flame-cut surface causes greater wear on machine tools and necessitates more machining time in the subsequent machining operation. If only the outer circumference of the workpiece is flame-cut, the cutting can be done shortly after the workpiece is removed from the forging press while it is still hot, and the last two heating steps can be avoided.

An object of the present invention is to provide an improved method and mechanism for forming a hole through a forged workpiece in which the hole is formed in a hot-trepanning operation before the hot workpiece is removed from the forging press following the forging operation.

A further object is to provide an improved hole-forming method and mechanism which accomplish the foregoing object, and in which the press has a die member for forming an indentation in the upper surface of a workpiece for closely receiving a trepanning tool.

A further object is to provide an improved trepanning tool which creates negative inner and outer wall hoop stresses in a workpiece, whereby the resulting hole is dimensioned accurately and machining is minimized, and the trepanning tool can be stripped readily from the core.

A further object is to provide an improved means for locating a workpiece and a trepanning tool in alignment with the top die of a forging press, thereby facilitating use of the top die for knocking out the thin wall of material which remains at the bottom of the trepanned hole after the trepanning operation.

Figure 1:
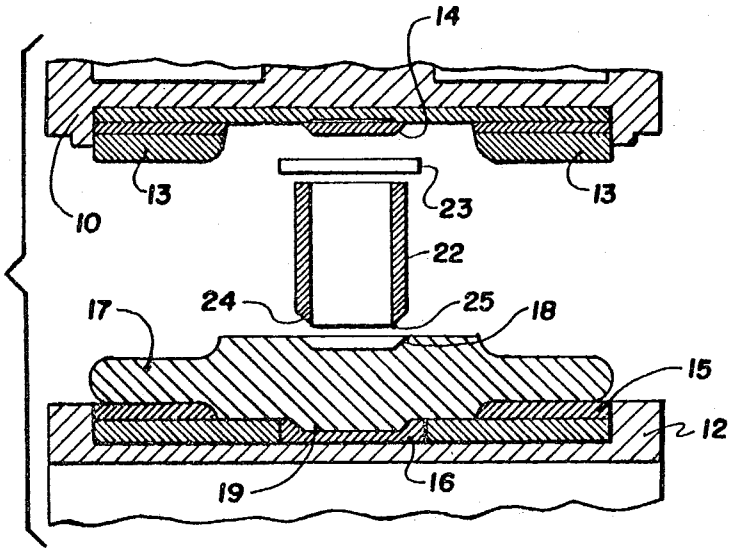
FIG. 1 is a diagrammatic exploded side elevational view, partly in section, showing parts of a forging press similar to that shown in my earlier patent, but equipped with die members in accordance with the present invention, and a trepanning tool.

FIG. 1 shows cooperating top and bottom die holders 10 and 12 of a forging press similar to the press shown in my earlier patent. The top die holder 10 carries a set of top dies 13, including a male die member 14 at the center in accordance with the present invention. The bottom die holder 12 carries a set of bottom dies 15, including a female die member 16 aligned with the male die member 14, likewise in accordance with the invention. A hot newly forged workpiece 17 is shown resting on the bottom dies 15. The workpiece has an indentation 18 at the center of its upper surface and a protrusion 19 on its lower surface aligned with the indentation formed by the male and female die members 14 and 16 respectively. Reference can be made to my earlier patent for a showing of the remainder of the press and a description of its operation; hence the showing and description are not repeated here.

FIG. 1 shows a trepanning tool 22 and plate 23 positioned over the workpiece 17. The trepanning tool is tubular and has an external sloping face 24 extending around its circumference at its lower end. The male and female die members 14 and 16 have tapered circumferential edges matching the slope in the end portion of the tool and they are of a diameter substantially equal to the tool diameter. Hence the indentation 18 can receive the sloping face of the tool, and properly centers the tool for trepanning a hole in the workpiece. Before I remove the hot workpiece 17 from the press following the forging operation, I place the sloping face 24 of the tool in the indentation 18 and place the plate 23 on the tool. I operate the press to bring the top die assembly down against the plate to force the tool into the workpiece.

Figure 2:
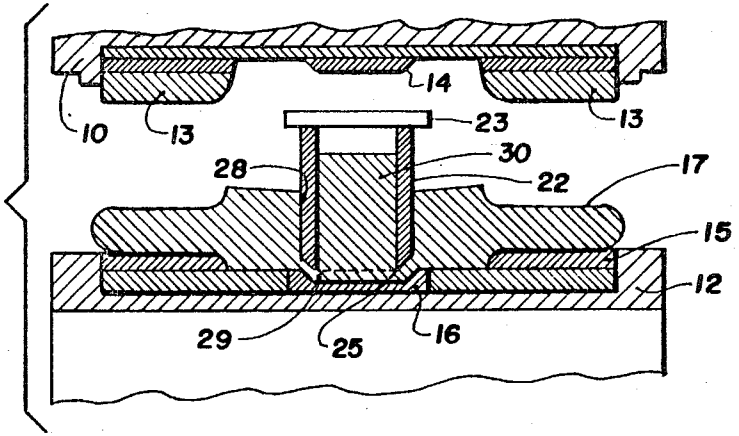
FIG. 2 is a diagrammatic view similar to FIG. 1 but showing the position of the trepanning tool near the end of the trepanning operation.

FIG. 2 shows the position of the tool 22 near the end of the trepanning operation. The tool has been forced almost through the workpiece 17 forming a hole 28 by an extruding action, but leaving a thin wall 29 at the protrusion 19. The material extruded from the workpiece forms a core 30 which can be reclaimed for other use.

Figure 3:
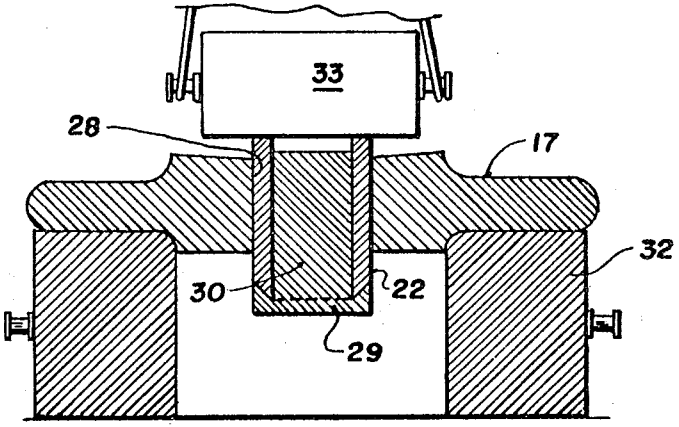
FIG. 3 is a diagrammatic vertical sectional view illustrating one method by which the thin wall at the bottom of the hole may be knocked out to complete the hole.

Next I force the tool 22 all the way through the workpiece 17 to complete the hole 28. As shown in FIG. 3, to accomplish this, I may remove the workpiece, core and tool from the press and place them on an annular support 32. Conveniently I hit the tool with a suspended weight 33 to knock out the thin wall 29, which remains integral with the core 30.

Figure 4:
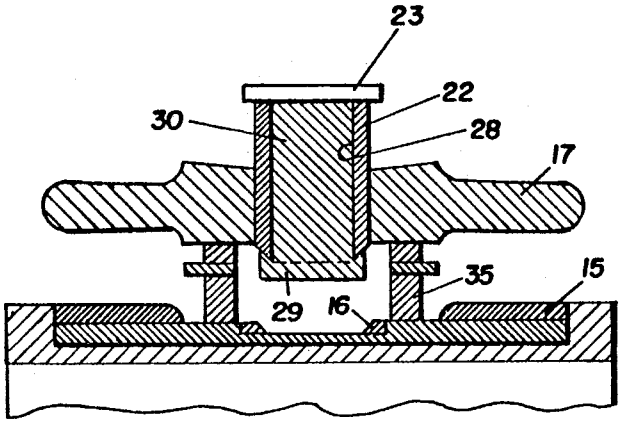
FIG. 4 is a diagrammatic vertical sectional view showing an alternative method of knocking out the wall.

Alternatively I may complete the hole while the workpiece 17 remains in the press, as shown in FIG. 4. I raise the workpiece and place an annular support 35 on the bottom dies 15. I then use the plate 23 and top dies 13 to force the tool 22 all the way through the workpiece and knock out the thin wall 29.

Figure 5:
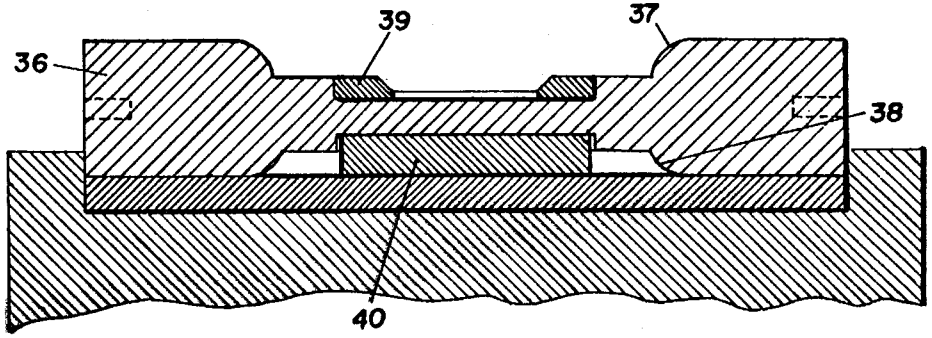
FIG. 5 is a diagrammatic vertical sectional view of a modified form of bottom die.

FIG. 5 shows an alternate form of bottom die 36 which is reversible to enable forgings of different configurations to be formed. The upper and lower faces of the die have inner circumferential edges 37 and 38 of different radii. I place a female die member 39 on the upper surface of die 36 as in the embodiment already described. I place a plate 40 under the die 36 to provide support where the die itself is relatively thin.

Figure 6:
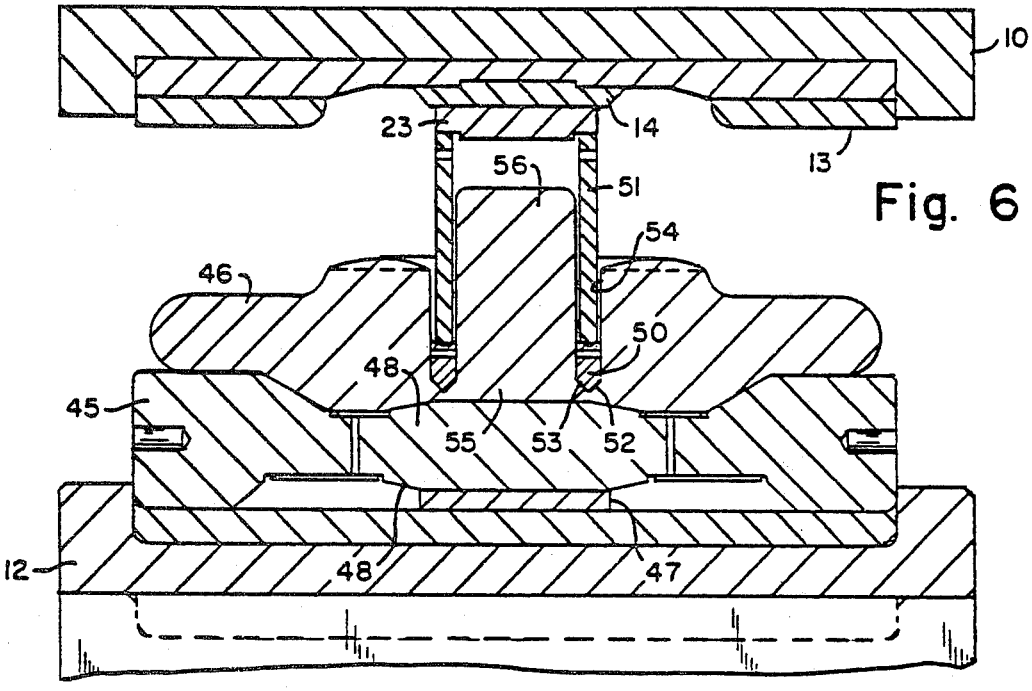
FIG. 6 is a partly diagrammatic vertical sectional view of parts of a forging press illustrating another modified form of bottom die, and an improved trepanning tool.
Figure 7:
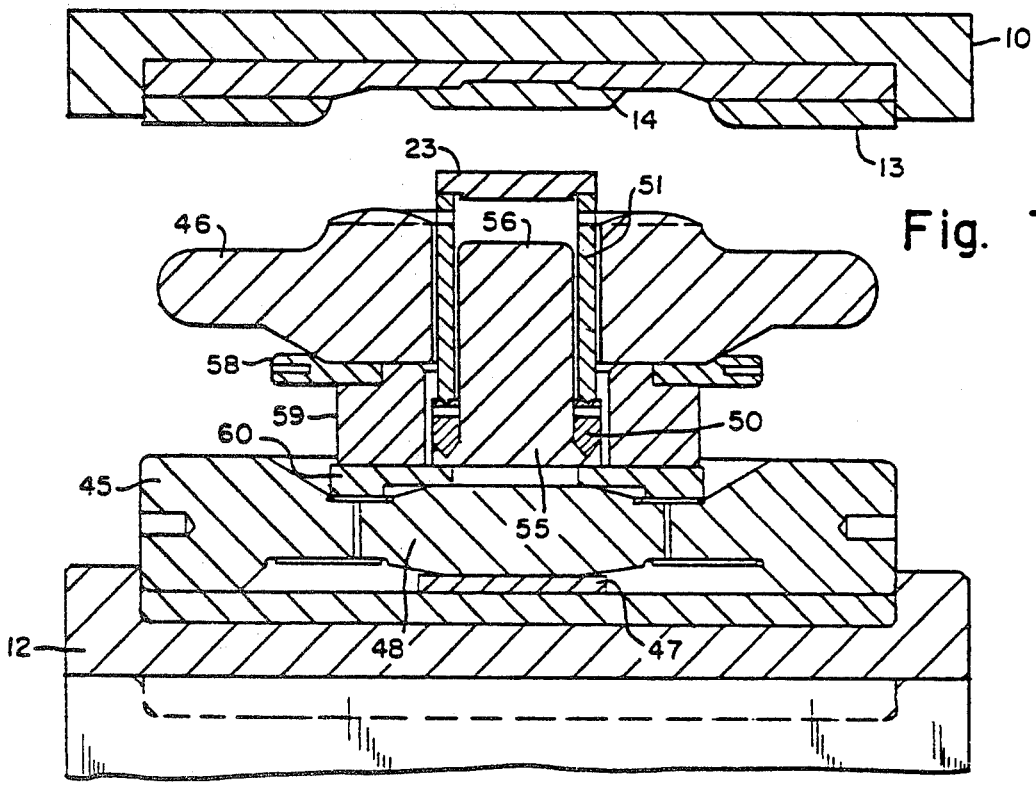
FIG. 7 is a partly diagrammatic vertical sectional view of the parts shown in FIG. 6, but showing the workpiece supported for knocking out the wall at the bottom of the trepanned hole.

FIGS. 6 and 7 illustrate my now preferred apparatus for hot-trepanning a workpiece in accordance with the invention. FIGS. 6 and 7 show several modifications from the embodiments of the invention thus far described, but the press itself again may be similar to that shown in my aforementioned earlier patent.

FIGS. 6 and 7 show another form of bottom die 45 which can be reversed for forging workpieces 46 to different configurations. The central portion of the die rests on a plate 47, which provides support similar to the arrangement shown in FIG. 5. The central portion has raised areas 48 top and bottom. The female die member shown in the other embodiments is omitted, since I have found the protrusion on the bottom of the workpiece is not necessary.

Figure 8:
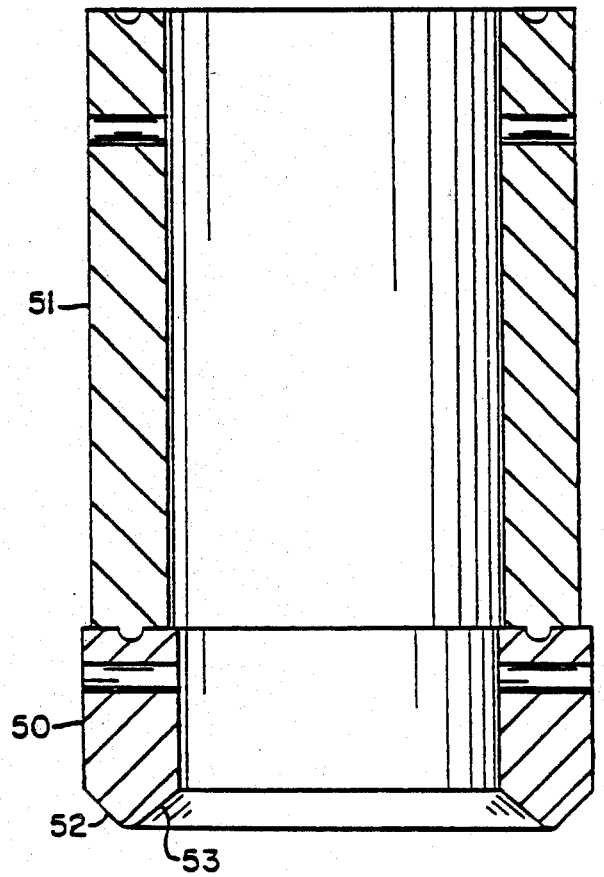
FIG. 8 is a vertical sectional view on a larger scale of my improved trepanning tool.

FIGS. 6, 7 and 8 show an improved trepanning tool formed of a separate tubular head 50 and an interfitting tubular follower 51. As best shown in FIG. 8, the follower has a slightly smaller outside diameter than the head, and a slightly larger inside diameter. For example in a tool which has a diameter of 26 inches at the middle of the wall section, the the outside diameter of the follower may be about $\frac{3}{4}$ inch smaller than the outside diameter of the head, and the inside diameter about $\frac{3}{4}$ inch larger. By making the tool of a separate head and follower, I substantially reduce the cost, since the head is formed of a costly alloy tool steel. The head has external and internal sloping faces 52 and 53 extending around its circumference at its lower end. As best shown in FIG. 6, the tool is used in the same way as the tool of the embodiments already described to form a hole 54 in the workpiece, but leaving a thin wall 55 at the bottom and forming a core 56. As the head is forced into the workpiece, the sloping faces 52 and 53 are subject to opposing forces which create negative inner and outer wall hoop stresses. As a result, the hole is formed accurately, and minimum machining is needed around the hole.

FIG. 7 shows the parts set up for knocking out the wall 55 while the workpiece 46 remains in the press. The workpiece is lifted and placed on a locating ring 58, which rests on a stripping ring 59 and an annular support 60. Conveniently parts 58, 59 and 60 are bolted together to facilitate placing them in the press. The support 60 fits on the raised portion 48 of the bottom die 45. The locating ring is contoured to match the bottom of the workpiece and thus locates the workpiece and trepanning tool in alignment with the top die, which then is used to knock out the wall 55, as in the embodiment shown in FIG. 4. As shown in FIG. 6, the raised portion 48 of the bottom die 45 produces a dished area in the bottom of the workpiece 46. As shown in FIG. 7, when the wall 55 is knocked out, the force applied to the metal immediately adjacent the hole 54 flattens out this dished area. The surfaces of the follower 51 are spaced from both the surface of the workpiece at the hole and the surface of the core. Hence the follower is easily stripped from both the workpiece and the core.

It is important to emphasize the difference between a hot-trepanning operation and a hot-cutting or punching operation. A hot-trepanning operation is actually an extruding operation and must be performed while the metal is at a high temperature and capable of good plastic flow, thereby removing all the volume of material in the hole area. The metal directly under the trepanning tool actually flows into the core. This removes all the segregated axial area of the material which is not an uncommon characteristic of large size ingots required to produce large forgings, such as bucket wheels, turbine discs, etc. Hot-trepanning also lessens the possibility of any incipient tears in the grain boundaries of the hub area. The hub area around the hole receives additional hot working by the hot-trepanning operation which helps produce the finer grain size and aids in increasing the Charpy impact energy level, which is very important in large electrical forgings. A hole that is cut by hot-shearing requires extremely close tolerances between a bottom die ring backup and punch and is not conducive or practical in producing large holes at high temperatures. A hole that is hot-punched is produced by a shearing and wiping action. The volume of material being removed is considerably less than that contained in the hole area. In other words a considerable amount of the material goes into the forged piece. The amount is a function of the hole diameter and the depth of the hole.

From the foregoing description it is seen that my invention affords a simple method and mechanism which facilitates and expedites forming a hole through a forged workpiece. The invention not only overcomes the need for two heating steps required when the hole is flame-cut, but provides a smoothfaced hole which is much more readily machined than a workpiece with a flame-cut hole. The invention also facilitates flame-cutting and machining the outside circumference of the workpiece. As soon as the workpiece is removed from the press and while it is still hot, a tapered plug can be placed in the hole to support a flame-cutting tool which traversed the outside circumference. Flame-cutting while the workpiece is hot off of the press and prior to the following normalizing and tempering heat treatment provides a better condition for machining the outer circumference of the workpiece.

It is apparent the forging shown in FIGS. 6 and 7 can be formed with a bottom protrusion if desired. It is apparent also that the bottom die, trepanning tool, and/or locater stripping rings shown in FIGS. 6 and 7 can be used with the other embodiments of the invention.

I claim:

1. In a forging press which includes cooperating sets of top and bottom dies for shaping a workpiece heated to a hot forging temperature, the combination therewith of an improved mechanism for forming a hole through the workpiece, said mechanism comprising:

a male die member in said set of top dies engageable with the upper surface of the workpiece for forming an indentation therein; and a tubular trepanning tool having at least one sloping face extending around its circumference at its lower end;

said male die member having tapered circumferential edges matching the sloping face of said tool and being of a diameter substantially equal to the tool diameter, whereby the indentation formed in the workpiece receives the sloping face of said tool and serves to center it;

said set of top dies being adapted to apply force to said tool to hot-trepan a hole in the workpiece at the indentation before the workpiece is removed from the press following the forging operation.

2. A press as defined in claim 1 including a reversible bottom die and a supporting plate under said reversible bottom die.

3. A press as defined in claim 1 in which said tool has external and internal sloping faces for creating negative external and internal hoop stresses in the workpiece.

4. A press as defined in claim 3 in which said tool is formed of a separate head and an interfitting follower.

* * * * *